US011988419B2

(12) United States Patent
Ishiyama et al.

(10) Patent No.: US 11,988,419 B2
(45) Date of Patent: May 21, 2024

(54) REFRIGERATION CYCLE APPARATUS

(71) Applicant: Mitsubishi Electric Corporation, Tokyo (JP)

(72) Inventors: Hiroki Ishiyama, Tokyo (JP); Yusuke Shimazu, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 362 days.

(21) Appl. No.: 17/430,764

(22) PCT Filed: Apr. 5, 2019

(86) PCT No.: PCT/JP2019/015152
§ 371 (c)(1),
(2) Date: Aug. 13, 2021

(87) PCT Pub. No.: WO2020/202555
PCT Pub. Date: Oct. 8, 2020

(65) Prior Publication Data

US 2022/0154981 A1 May 19, 2022

(51) Int. Cl.
*F25B 31/00* (2006.01)

(52) U.S. Cl.
CPC ..... *F25B 31/002* (2013.01)

(58) Field of Classification Search
CPC .. F25B 31/002; F25B 31/004; F25B 2500/16; F25B 2600/0251; F25B 2600/23; F25B 2700/03; F25B 43/02; F25B 59/02
See application file for complete search history.

(56) References Cited

FOREIGN PATENT DOCUMENTS

| | | | | | |
|---|---|---|---|---|---|
| CN | 104913556 | A | | 9/2015 | |
| EP | 3 225 938 | A1 | | 10/2017 | |
| EP | 3 296 664 | A1 | | 3/2018 | |
| EP | 3 643 979 | A1 | | 4/2020 | |
| JP | 2003-106690 | A | | 4/2003 | |
| JP | 2003106690 | A | * | 4/2003 | |
| JP | 2016-194389 | A | | 11/2016 | |
| JP | 2016194389 | A | * | 11/2016 | |
| JP | 2018-173194 | A | | 11/2018 | |
| JP | 6896100 | B2 | * | 6/2021 | ..... F25B 31/002 |
| KR | 20080065191 | A | * | 7/2008 | ..... F04C 28/08 |
| KR | 2208481 | B1 | * | 1/2021 | |
| KR | 102208481 | B1 | * | 1/2021 | ..... F25B 43/02 |

(Continued)

OTHER PUBLICATIONS

Office Action dated Aug. 23, 2022 issued in the counterpart Chinese Patent Application No. 201980094603.3 (and English translation).

(Continued)

*Primary Examiner* — Emmanuel E Duke
(74) *Attorney, Agent, or Firm* — POSZ LAW GROUP, PLC

(57) ABSTRACT

A refrigerant circuit includes a compressor, a high-pressure side heat exchanger, a decompressor, and a low-pressure side heat exchanger, which are annularly interconnected by a refrigerant pipe, and is configured to circulate refrigerant. The refrigerant circuit performs an oil recovery operation based on an operation history of the compressor during a normal operation of the refrigerant circuit and an amount of oil in the compressor detected by an oil depletion sensor.

10 Claims, 5 Drawing Sheets

(56) References Cited

FOREIGN PATENT DOCUMENTS

| | | | | |
|---|---|---|---|---|
| WO | 2018/235262 | A1 | 12/2018 | |
| WO | WO-2018235262 | A1 * | 12/2018 | ..... F25B 1/00 |
| WO | WO-2020122615 | A1 * | 6/2020 | ..... F25B 31/004 |

OTHER PUBLICATIONS

Office Action dated Aug. 30, 2022 issued in the counterpart Japanese Patent Application No. 2021-511056 (and English translation).
Office Action dated Feb. 17, 2023 issued in the counterpart CN Patent Application No. 201980094603.3 (and English translation).
International Search Report of the International Searching Authority dated Jun. 18, 2019 for the corresponding International application No. PCT/JP2019/015152 (and English translation).
The Extended European Search Report dated Mar. 7, 2022 issued in corresponding EP patent application No. 19922909.7.
Office Action dated Sep. 14, 2023 issued in the counterpart CN Patent Application No. 201980094603.3 (and English translation).

* cited by examiner

REFRIGERATION CYCLE APPARATUS

CROSS REFERENCE TO RELATED APPLICATION

This application is a U.S. national stage application of PCT/JP2019/015152 filed on Apr. 5, 2019, the contents of which are incorporated herein by reference.

TECHNICAL FIELD

The present invention relates to a refrigeration cycle apparatus.

BACKGROUND ART

There is known a refrigeration cycle apparatus having a function of performing an oil return operation so as to return lubricating oil to a compressor. For example, the refrigeration cycle apparatus described in PTL 1 has a function of determining that the compressor is operated at a low capacity where it is necessary to perform an oil return operation so as to return oil to the compressor and counting the operation time at the low capacity, a function of counting the number of start/stop times of the compressor, and a function of performing an oil return operation when the total operation time of the compressor at the low capacity is longer than a preset total operation time and the number of start/stop times of the compressor is greater than a preset number of start/stop times.

CITATION LIST

Patent Literature

PTL 1: Japanese Patent Laying-Open No. 2016-194389

SUMMARY OF INVENTION

Technical Problem

However, in the refrigeration cycle apparatus described in PTL 1, the preset total operation time and the preset number of start/stop times are constant. Therefore, depending on the state of the refrigeration cycle apparatus, a property of the refrigerant circuit or the like, the oil return operation is performed even when an oil depletion does not occur. In addition, even if the oil depletion is solved as a result of the oil return operation, the oil return operation may not be terminated at an appropriate timing. As a result, the comfort provided by the refrigeration cycle apparatus and the performance of the refrigeration cycle apparatus may be deteriorated.

Therefore, it is an object of the present invention to provide a refrigeration cycle apparatus which performs an oil return operation only when the possibility for an oil depletion to occur is high.

Solution to Problem

A refrigeration cycle apparatus according to a first aspect of the present invention includes a refrigerant circuit. The refrigerant circuit includes a compressor, a high-pressure side heat exchanger, a decompressor, and a low-pressure side heat exchanger, which are annularly connected by a refrigerant pipe, and the refrigerant circuit is configured to circulate refrigerant. The refrigeration cycle apparatus further includes a sensor configured to detect an amount of oil in the compressor. The refrigerant circuit performs an oil recovery operation based on an operation history of the compressor during a normal operation of the refrigerant circuit and the amount of oil in the compressor.

A refrigeration cycle apparatus according to a second aspect of the present invention includes a refrigerant circuit. The refrigerant circuit includes a compressor, a high-pressure side heat exchanger, a decompressor, and a low-pressure side heat exchanger, which are annularly connected by a refrigerant pipe, and the refrigerant circuit is configured to circulate refrigerant. The refrigeration cycle apparatus further includes a sensor configured to detect an amount of oil in the compressor. The refrigerant circuit performs an oil recovery operation based on an operation history of the compressor during a normal operation of the refrigerant circuit. When the amount of oil in the compressor detected by the sensor is equal to or greater than a prescribed value during the oil recovery operation of the refrigerant circuit, the refrigerant circuit terminates the oil recovery operation.

Advantageous Effects of Invention

According to the first aspect of the present invention, the refrigerant circuit performs the oil recovery operation based on the operation history of the compressor during the normal operation of the refrigerant circuit and the amount of oil in the compressor. Thus, the oil return operation is performed only when the possibility for an oil depletion to occur is high.

According to the second aspect of the present invention, the refrigerant circuit terminates the oil recovery operation when the amount of oil in the compressor detected by the sensor is equal to or greater than the prescribed value during the oil recovery operation of the refrigerant circuit. Thus, the oil return operation is performed only when the possibility for an oil depletion to occur is high.

DESCRIPTION OF EMBODIMENTS

Hereinafter, embodiments will be described with reference to the drawings.

First Embodiment

Figure 1:
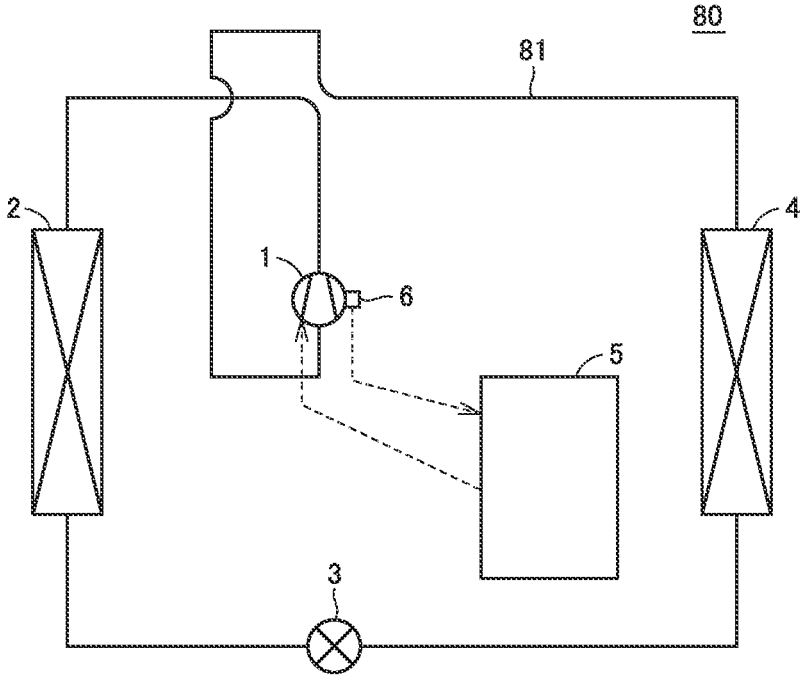
FIG. 1 is a diagram illustrating a configuration of a refrigeration cycle apparatus according to a first embodiment.

FIG. 1 is a diagram illustrating a configuration of a refrigeration cycle apparatus according to a first embodiment.

The refrigeration cycle apparatus includes a refrigerant circuit 80, an oil depletion sensor 6, and a controller 5.

The refrigerant circuit 80 includes a compressor 1, a high-pressure side heat exchanger 2, a decompressor 3, and a low-pressure side heat exchanger 4, which are annularly connected by a refrigerant pipe 81.

The refrigerant circuit 80 is configured to circulate refrigerant. The compressor 1 is configured to allow capacity control. The compressor 1 sucks in low pressure refrigerant, compresses the low pressure refrigerant into high pressure refrigerant, and discharges the high pressure refrigerant. The high-pressure side heat exchanger 2 functions as a condenser. The high-pressure side heat exchanger 2 condenses the high pressure refrigerant compressed by the compressor 1. The decompressor 3 depressurizes the high pressure refrigerant condensed by the high-pressure side heat exchanger 2. The low-pressure side heat exchanger 4 functions as an evaporator. The low-pressure side heat exchanger 4 evaporates the refrigerant depressurized by the decompressor 3.

The refrigerant circuit 80 is sealed with refrigeration oil. In the following description, the refrigerator oil is simply referred to as oil. The refrigerant circuit 80 is controlled to perform either a normal operation or an oil recovery operation.

(Normal Operation)

The liquid mixture of refrigerant and oil discharged from the compressor 1 flows through the high-pressure side heat exchanger 2, the decompressor 3 and the low-pressure side heat exchanger 4 in this order into the compressor 1. In the normal operation, since the amount of the liquid mixture discharged from the compressor 1 increases abruptly at the start of the compressor 1, the frequency of the compressor 1 decreases for a short time. As a result, the liquid mixture remains in the high-pressure side heat exchanger 2, the decompressor 3, the low-pressure side heat exchanger 4 and the refrigerant pipe 81, whereby the amount of the liquid mixture flowing into the compressor 1 decreases. After the compressor 1 is finally stopped, the liquid mixture in the refrigerant circuit 80 flows according to a pressure difference in the refrigerant circuit 80. Therefore, during the normal operation, in one cycle from the start to the stop of the compressor 1, although the outflow amount of oil from the compressor 1 increases, the inflow amount (the oil return amount) decreases. As the compressor 1 performs such intermittent operation repeatedly, the amount of oil in the compressor 1 will decrease. During the normal operation of the refrigerant circuit 80, the compressor 1 is repeatedly started and stopped. A total operation time Tt of the compressor 1 during the normal operation of the refrigerant circuit 80 is the sum of the operation time of the compressor 1 during the normal operation of the refrigerant circuit 80. When the time from the start to the stop of the compressor 1 is defined as a cycle time, the total operation time Tt is the sum of one or more cycle times during the normal operation of the refrigerant circuit 80. The number of start/stop times Nt of the compressor 1 during the normal operation of the refrigerant circuit 80 is the sum of the number of start times where the compressor 1 is started and the number of stop times where the compressor 1 is stopped during the normal operation of the refrigerant circuit 80.

(Oil Recovery Operation)

During the normal operation, the oil remains in each component of the refrigerant circuit 80. In an oil recovery operation, for example, the frequency of the compressor 1 is increased greater than the frequency thereof during the normal operation, or the opening degree of the decompressor 3 is increased. As a result, the oil flows out from each component of the refrigerant circuit 80, and thereby, the amount of oil flowing into the compressor 1 (the oil return amount) increases.

The oil depletion sensor 6 detects an amount of oil Om in the compressor 1. The oil depletion sensor 6 may be a liquid level sensor or an oil concentration sensor.

In the present embodiment, the controller 5 controls the refrigerant circuit 80 to perform an oil recovery operation when the total operation time Tt of the compressor 1 during the normal operation of the refrigerant circuit 80 is longer than a preset reference time Tth and the amount of oil Om in the compressor 1 is equal to or smaller than a prescribed value Oth.

The controller 5 resets the total operation time Tt to 0 when the total operation time Tt of the compressor 1 during the normal operation of the refrigerant circuit 80 is longer than the preset reference time Tth and the amount of oil Om in the compressor 1 is greater than the prescribed value Oth.

Figure 2:
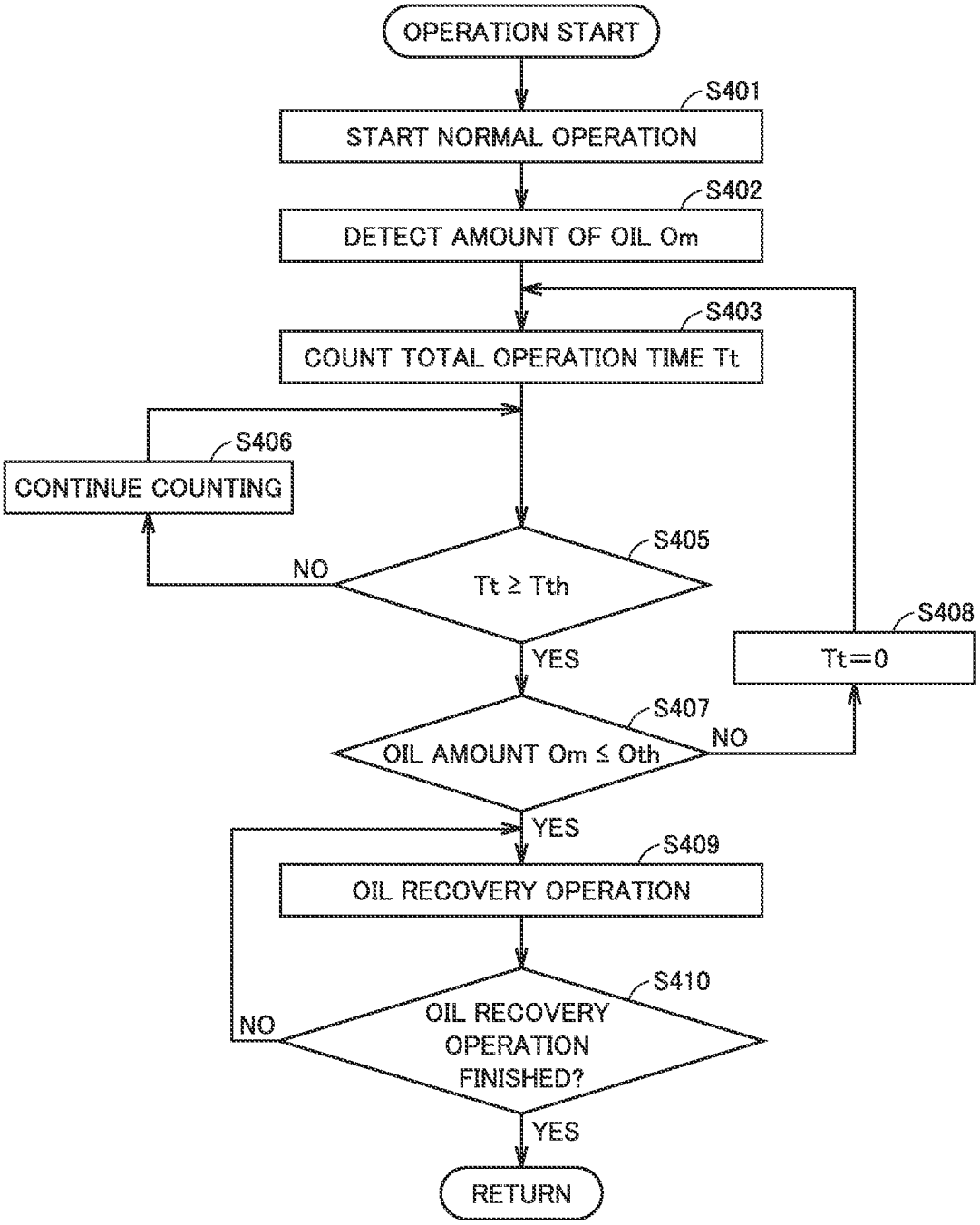
FIG. 2 is a flowchart illustrating a control process of the refrigeration cycle apparatus according to the first embodiment.

FIG. 2 is a flowchart illustrating a control process of the refrigeration cycle apparatus according to the first embodiment.

In step S401, the controller 5 starts a normal operation of the refrigerant circuit 80.

In step S402, the controller 5 detects the amount of oil Om in accordance with a signal from the oil depletion sensor 6.

In step S403, the controller 5 counts the total operation time Tt of the compressor 1 from the start of the normal operation of the refrigerant circuit 80.

In step S405, if Tt<Tth, the process proceeds to step S406; and if Tt≥Tth, the process proceeds to step S407. The reference time Tth is set preliminarily.

In step S406, the controller 5 continues counting the total operation time Tt. Thereafter, the process returns to step S405.

In step S407, if the amount of oil Om is equal to or smaller than the prescribed value Oth, the process proceeds to step S409; and if the amount of oil Om is greater than the prescribed value Oth, the process proceeds to step S408. The prescribed value Oth is set preliminarily.

In step S408, the controller 5 resets the total operation time Tt to 0. Thereafter, the process returns to step S403.

In step S409, the controller 5 controls the refrigerant circuit 80 to perform an oil recovery operation. In the oil recovery operation, for example, the controller 5 increases the number of revolutions of the compressor 1. Accordingly, the amount of oil flowing out from each component of the refrigerant circuit 80 increases, and thereby, the amount of oil flowing into the compressor 1 (the oil return amount) increases.

In step S410, when the oil recovery operation of the refrigerant circuit 80 is finished, the process is ended.

As described above, according to the present embodiment, when the total operation time of the compressor is short or the amount of oil in the compressor is great, the necessity of the oil recovery operation is low, whereby the oil recovery operation is not performed, which makes it possible to prevent the comfort provided by the refrigeration cycle apparatus from being deteriorated. According to the present embodiment, when the total operation time of the compressor is long and the amount of oil in the compressor is small, the necessity of the oil recovery operation is high, whereby the oil recovery operation is performed, which makes it possible to improve the reliability of the compressor 1.

Second Embodiment

In the present embodiment, when the number of start/stop times Nt of the compressor 1 during the normal operation of the refrigerant circuit 80 is greater than the preset reference number of times Nth and the amount of oil Om in the compressor 1 is equal to or smaller than the prescribed value Oth, the controller 5 controls the refrigerant circuit 80 to perform an oil recovery operation.

The controller 5 resets the number of start/stop times Nt to 0 when the number of start/stop times Nt of the compressor 1 during the normal operation of the refrigerant circuit 80 is greater than the preset reference number of times Nth and the amount of oil Om in the compressor 1 is greater than the prescribed value Oth.

Figure 3:
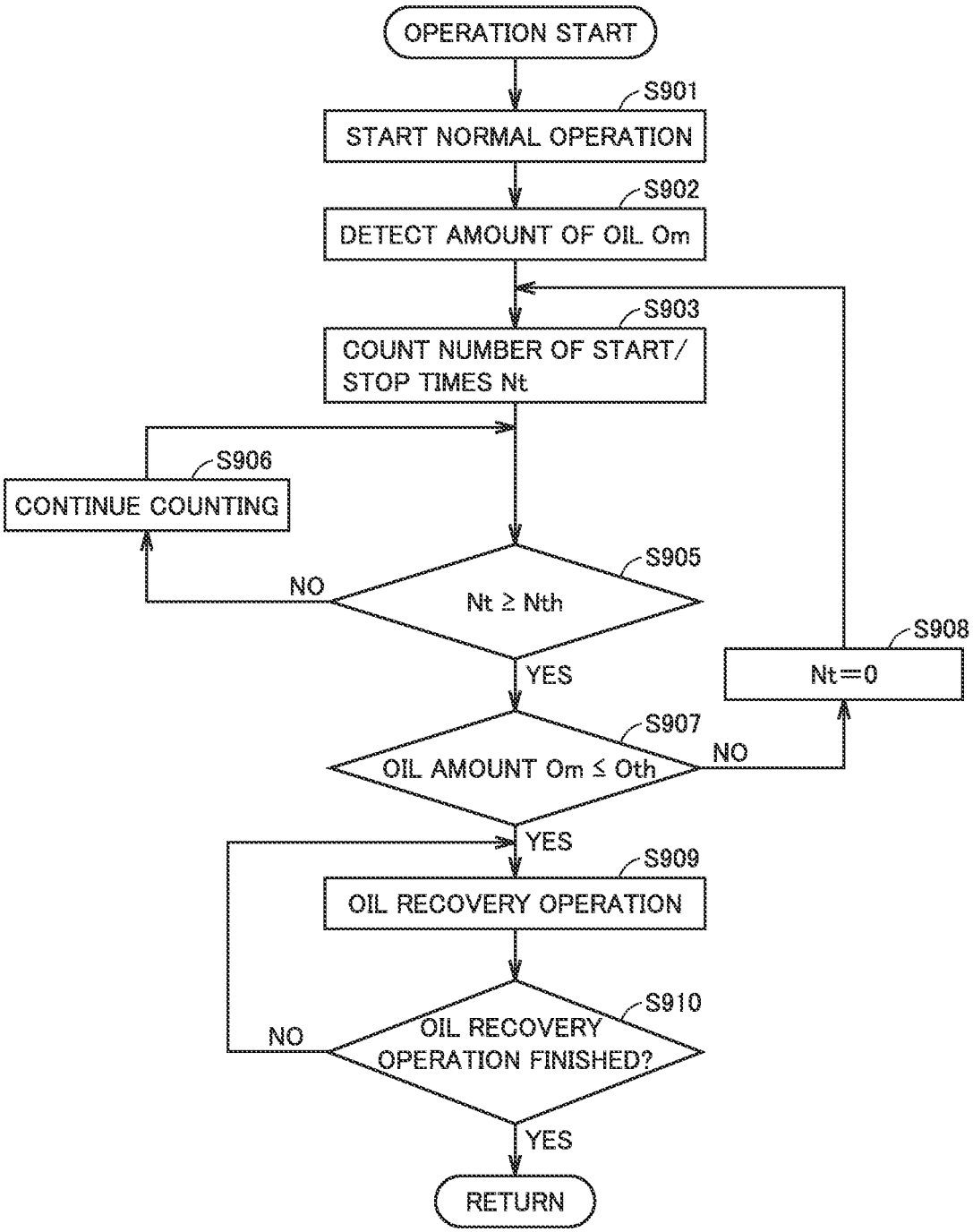
FIG. 3 is a flowchart illustrating a control process of a refrigeration cycle apparatus according to a second embodiment.

FIG. 3 is a flowchart illustrating a control procedure of the refrigeration cycle apparatus according to the second embodiment.

In step S901, the controller 5 starts a normal operation of the refrigerant circuit 80.

In step S902, the controller 5 detects the amount of oil Om in accordance with a signal from the oil depletion sensor 6.

In step S903, the controller 5 counts the number of start/stop times Nt of the compressor 1 from the start of the normal operation of the refrigerant circuit 80.

In step S905, if Nt<Nth, the process proceeds to step S906; and if Nt≥Nth, the process proceeds to step S907. The reference count Nth is set preliminarily.

In step S906, the controller 5 continues counting the number of start/stop times Nt. Thereafter, the process returns to step S905.

In step S907, if the amount of oil Om is equal to or smaller than the prescribed value Oth, the process proceeds to step S909; and if the amount of oil Om is greater than the prescribed value Oth, the process proceeds to step S908.

In step S908, the controller 5 resets the number of start/stop times Nt to 0. Thereafter, the process returns to step S903.

In step S909, the controller 5 controls the refrigerant circuit 80 to perform an oil recovery operation. In the oil recovery operation, for example, the controller 5 increases the number of revolutions of the compressor 1. Accordingly, the amount of oil flowing out from each component of the refrigerant circuit 80 increases, and thereby, the amount of oil flowing into the compressor 1 (the oil return amount) increases.

When the oil recovery operation of the refrigerant circuit 80 is finished in step S910, the process is ended.

As described above, according to the present embodiment, when the number of start/stop times of the compressor is small or the amount of oil in the compressor is great, the necessity of the oil recovery operation is low, whereby the oil recovery operation is not performed, which makes it possible to prevent the comfort provided by the refrigeration cycle apparatus from being deteriorated. According to the present embodiment, when the number of start/stop times of the compressor is great and the amount of oil in the compressor is small, the necessity of the oil recovery operation is high, whereby the oil recovery operation is performed, which makes it possible to improve the reliability of the compressor 1.

Third Embodiment

In the present embodiment, when the total operation time Tt of the compressor 1 during the normal operation of the refrigerant circuit 80 is longer than the predetermined reference time Tth, the controller 5 controls the refrigerant circuit 80 to perform the oil recovery operation; and when the amount of oil Om in the compressor 1 is equal to or greater than the prescribed value Oth during the oil recovery operation of the refrigerant circuit 80, the controller 5 terminates the oil recovery operation of the refrigerant circuit 80.

Figure 4:
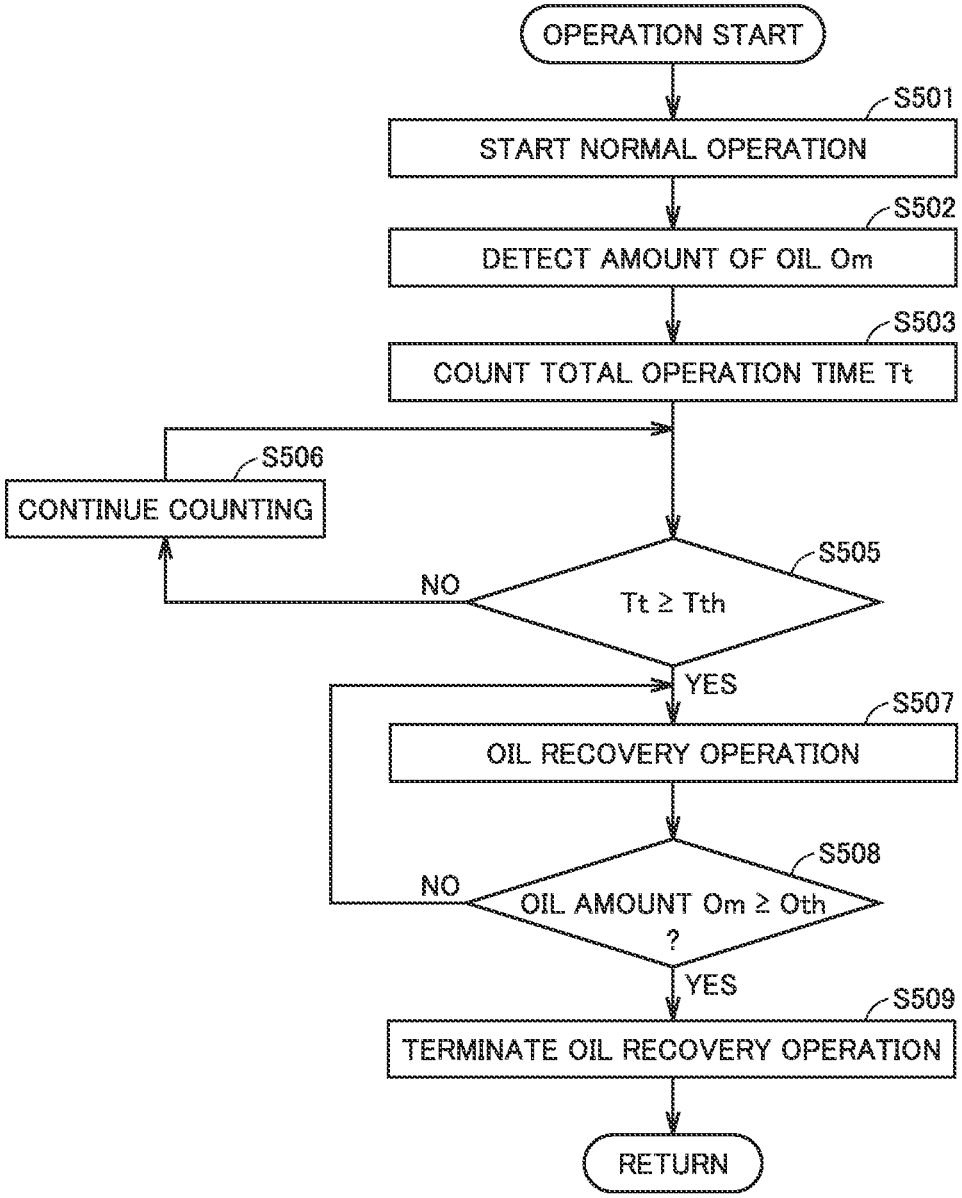
FIG. 4 is a flowchart illustrating a control process of a refrigeration cycle apparatus according to a third embodiment.

FIG. 4 is a flowchart illustrating a control procedure of the refrigeration cycle apparatus according to the third embodiment.

In step S501, the controller 5 starts a normal operation of the refrigerant circuit 80.

In step S502, the controller 5 detects the amount of oil Om in accordance with a signal from the oil depletion sensor 6.

In step S503, the controller 5 counts the total operation time Tt of the compressor 1 from the start of the normal operation of the refrigerant circuit 80.

In step S505, if Tt<Tth, the process proceeds to step S506; and if Tt≥Tth, the process proceeds to step S507. The reference time Tth is set preliminarily.

In step S506, the controller 5 continues counting the total operation time Tt. Thereafter, the process returns to step S505.

In step S507, the controller 5 controls the refrigerant circuit 80 to perform an oil recovery operation. In the oil recovery operation, for example, the controller 5 increases the number of revolutions of the compressor 1. Accordingly, the amount of oil flowing out from each component of the refrigerant circuit 80 increases, and thereby, the amount of oil flowing into the compressor 1 (the oil return amount) increases.

In step S508, if the amount of oil Om is equal to or greater than the prescribed value Oth, the process proceeds to step S509; and if the amount of oil Om is smaller than the prescribed value Oth, the process returns to step S507. The prescribed value Oth is set preliminarily.

In step S509, the controller 5 terminates the oil recovery operation of the refrigerant circuit 80.

As described above, according to the present embodiment, the oil recovery operation may be terminated at an appropriate timing based on the amount of oil in the compressor detected during the oil recovery operation of the refrigerant circuit 80, which makes it possible to improve the comfort provided by the refrigeration cycle apparatus and the performance of the compressor.

Fourth Embodiment

In the present embodiment, when the number of start/stop times Nt of the compressor 1 during the normal operation of the refrigerant circuit 80 is greater than the preset reference number of times Nth, the controller 5 controls the refrigerant circuit 80 to perform the oil recovery operation; and when the amount of oil Om in the compressor 1 is equal to or greater than the prescribed value Oth, the controller 5 terminates the oil recovery operation of the refrigerant circuit 80.

Figure 5:
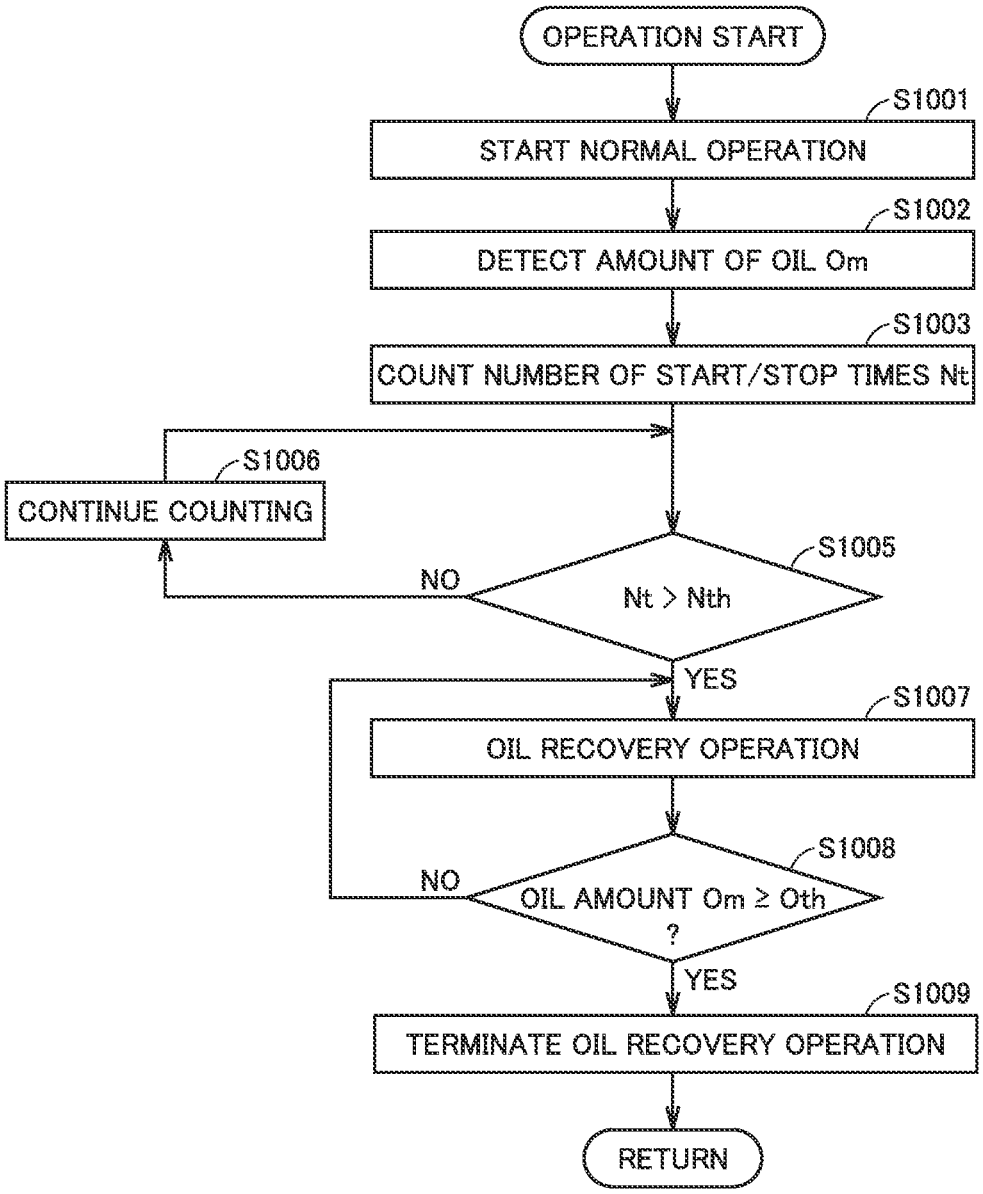
FIG. 5 is a flowchart illustrating a control process of a refrigeration cycle apparatus according to a fourth embodiment.

FIG. 5 is a flowchart illustrating a control process of the refrigeration cycle apparatus according to the fourth embodiment.

In step S1001, the controller 5 starts a normal operation of the refrigerant circuit 80.

In step S1002, the controller 5 detects the amount of oil Om in accordance with a signal from the oil depletion sensor 6.

In step S1003, the controller 5 counts the number of start/stop times Nt of the compressor 1 from the start of the normal operation of the refrigerant circuit 80.

In step S1005, if Nt<Nth, the process proceeds to step S1006; and if Nt≥Nth, the process proceeds to step S1007. The reference count Nth is set preliminarily.

In step S1006, the controller 5 continues counting the number of arbitrations Nt. Thereafter, the process returns to step S1005.

in step S1007, the controller 5 controls the refrigerant circuit 80 to perform an oil recovery operation. In the oil recovery operation, for example, the controller 5 increases the number of revolutions of the compressor 1. Accordingly, the amount of oil flowing out from each component of the refrigerant circuit 80 increases, and thereby, the amount of oil flowing into the compressor 1 (the oil return amount) increases.

If the amount of oil Om is equal to or greater than the prescribed value Oth in step S1008, the process proceeds to step S1009; and if the amount of oil Om is smaller than the prescribed value Oth, the process returns to step S1007. The prescribed value Oth is set preliminarily.

In step S1009, the controller 5 terminates the oil recovery operation of the refrigerant circuit 80.

As described above, according to the present embodiment, the oil recovery operation may be terminated at an appropriate timing based on the amount of oil in the compressor detected during the oil recovery operation of the refrigerant circuit 80, which makes it possible to improve the comfort provided by the refrigeration cycle apparatus and the performance of the compressor.

(Modifications)

In the above embodiments, the reference time Tth and the reference number of times Nth are set irrespective of the characteristics of the refrigerant circuit 80, but they are not limited thereto.

The controller 5 may set the reference time Tth based on the characteristics of the refrigerant circuit 80.

The controller 5 may decrease the reference time Tth as the length of the refrigerant pipe 81 becomes longer. Alternatively, the controller 5 may set the reference time Tth to A1 when the length of the refrigerant pipe 81 is equal to or longer than a prescribed length, and set the reference time Tth to B1 when the length of the refrigerant pipe 81 is smaller than the prescribed length (A1<B1).

Alternatively, the controller 5 may decrease the reference time Tth as the height difference of the refrigerant pipe 81 becomes greater. Alternatively, the controller 5 may set the reference time Tth to C1 when the height difference of the refrigerant pipe 81 is equal to or greater than a prescribed value, and set the reference time Tth to D1 when the height difference of the refrigerant pipe 81 is smaller than the prescribed value (C1<D1).

Alternatively, the controller 5 may decrease the reference time Tth as the outside air temperature becomes lower. Alternatively, the controller 5 may set the reference time Tth to E1 when the outside air temperature is equal to or higher than a prescribed temperature, and may set the reference time Tth to F1 when the outside air temperature is lower than the prescribed temperature (E1>F1).

Similarly, the controller 5 may set the reference number of times Nth based on the characteristics of the refrigerant circuit 80.

The controller 5 may decrease the reference number of times Nth as the length of the refrigerant pipe 81 becomes longer. Alternatively, the controller 5 may set the reference number of times Nth to A2 when the length of the refrigerant pipe 81 is equal to or longer than a prescribed length, and set the reference number of times Nth to B2 when the length of the refrigerant pipe 81 is smaller than the prescribed length (A2<B2).

Alternatively, the controller 5 may decrease the reference number of times Nth as the height difference of the refrigerant pipe 81 becomes greater. Alternatively, the controller 5 may set the reference number of times Nth to C2 when the height difference of the refrigerant pipe 81 is equal to or greater than a prescribed value, and set the reference number of times Nth to D2 when the height difference of the refrigerant pipe 81 is smaller than the prescribed value (C2<D2).

Alternatively, the controller 5 may decrease the reference number of times Nth as the outside air temperature becomes lower. Alternatively, the controller 5 may set the reference number of times Nth to E2 when the outside air temperature is equal to or higher than a prescribed temperature, and may set the reference number of times Nth to F2 when the outside air temperature is lower than the prescribed temperature (E2>F2).

It should be understood that the embodiment disclosed herein is merely by way of illustration and example but not limited in all aspects. The scope of the present invention is defined. by the terms of the claims, rather than the description above, and is intended to include any modifications within the meaning and scope equivalent to the terms of the claims.

The invention claimed is:

1. A refrigeration cycle apparatus comprising:

a refrigerant circuit including a compressor, a high-pressure side heat exchanger, a decompressor, and a low-pressure side heat exchanger, which are annularly connected by a refrigerant pipe, the refrigerant circuit being configured to circulate refrigerant;

a controller; and a sensor configured to detect an amount of oil in the compressor, the controller is configured to control the refrigerant circuit so as to perform an oil recovery operation based on a total operation time or a number of start/stop times of the compressor during a normal operation of the refrigerant circuit and the amount of oil in the compressor.

2. The refrigeration cycle apparatus according to claim 1, wherein when the total operation time of the compressor during the normal operation of the refrigerant circuit is longer than a reference time and the amount of oil in the compressor is equal to or smaller than a prescribed value, the refrigerant circuit performs the oil recovery operation.

3. The refrigeration cycle apparatus according to claim 2, wherein when the total operation time of the compressor during the normal operation of the refrigerant circuit is longer than the reference time and the amount of oil in the compressor is greater than the prescribed value, the total operation time is reset.

4. The refrigeration cycle apparatus according to claim 1, wherein when the number of start/stop times of the compressor during the normal operation of the refrigerant circuit is greater than a reference number of times and the amount of oil in the compressor is equal to or smaller than a prescribed value, the refrigerant circuit performs the oil recovery operation.

5. The refrigeration cycle apparatus according to claim 4, wherein when the number of start/stop times of the compressor during the normal operation of the refrigerant circuit is greater than the reference number of times and the amount of oil in the compressor is greater than the prescribed value, the number of start/stop times is reset.

6. The refrigeration cycle apparatus according to claim 1, wherein when the amount of oil in the compressor detected by the sensor is equal to or greater than a prescribed value during the oil recovery operation of the refrigerant circuit, the refrigerant circuit terminates the oil recovery operation.

7. The refrigeration cycle apparatus according to claim 6, wherein when the total operation time of the compressor during the normal operation of the refrigerant circuit is longer than a reference time, the refrigerant circuit performs the oil recovery operation.

8. The refrigeration cycle apparatus according to claim 6, wherein when the number of start/stop times of the compressor during the normal operation of the refrigerant circuit is greater than a reference number of times, the refrigerant circuit performs the oil recovery operation.

9. The refrigeration cycle apparatus according to claim 1, wherein the controller is further configured to responsive to a start of the normal operation of the refrigerant circuit in which the compressor is repeatedly started and stopped:

continue to count the total operation time of the compressor from the start of normal operation, responsive to the total operation time exceeding a reference time which is predetermined and the amount of oil in the compressor detected by the sensor being greater than a prescribed value which is a predetermined low capacity value, reset a count of the total operation time, responsive to the total operation time exceeding the predetermined reference time and the amount of oil detected by the sensor being less than or equal to the prescribed value, control the compressor of the refrigerant circuit to begin the oil recovery operation.

10. The refrigeration cycle apparatus according to claim 1, wherein the controller is further configured to responsive to a start of the normal operation of the refrigerant circuit in which the compressor is repeatedly started and stopped:

continue to count the number of start/stop times of the compressor, responsive to the number of start/stop times exceeding a reference number of times which is predetermined and the amount of oil in the compressor detected by the sensor being greater than a prescribed value which is a predetermined low capacity value, reset a count of the number of start/stop times, responsive to the number of start/stop times exceeding the reference number and the amount of oil detected by the sensor being less than or equal to the prescribed value, control the compressor of the refrigerant circuit to begin the oil recovery operation.

* * * * *